US009587641B2

(12) United States Patent
Mettler et al.

(10) Patent No.: US 9,587,641 B2
(45) Date of Patent: Mar. 7, 2017

(54) INTEGRATED RECIPROCATING PRIMER DRIVE ARRANGEMENT

(71) Applicant: Waterous Company, South St. Paul, MN (US)

(72) Inventors: Thomas Joseph Mettler, Hudson, WI (US); Mark Francis Haider, St. Paul, MN (US); Henry Yinwah Tsang, Roseville, MN (US); Brian Jacob Johnson, South St. Paul, MN (US); Jason Adam Smith, Hudson, WI (US); Robert Allen Johnson, White Bear Lake, MN (US)

(73) Assignee: Waterous Company, South St. Paul, MN (US)

( * ) Notice: Subject to any disclaimer, the term of this patent is extended or adjusted under 35 U.S.C. 154(b) by 626 days.

(21) Appl. No.: 13/861,174

(22) Filed: Apr. 11, 2013

(65) Prior Publication Data

US 2013/0272843 A1 Oct. 17, 2013

Related U.S. Application Data

(60) Provisional application No. 61/622,752, filed on Apr. 11, 2012.

(51) Int. Cl.
*F04D 27/02* (2006.01)
*F04D 17/08* (2006.01)
(Continued)

(52) U.S. Cl.
CPC ..... *F04D 17/08* (2013.01); *F04D 9/042* (2013.01); *F04D 9/043* (2013.01); *F04D 29/428* (2013.01)

(58) Field of Classification Search
USPC .. 415/1, 13, 16, 17, 25, 30, 203, 56.1, 56.6; 416/31, 45, 52
See application file for complete search history.

(56) References Cited

U.S. PATENT DOCUMENTS 2,255,239 A 9/1941 Allen
2,683,420 A 7/1954 Hill et al.
(Continued)

FOREIGN PATENT DOCUMENTS

BE 1006027 A5 4/1994
CN 2059688 U 7/1990
(Continued)

OTHER PUBLICATIONS

Notification of Transmittal of the International Search Report and the Written Opinion of the International Searching Authority, or the Declaration (PCT/US2013/036178) dated Jul. 22, 2013 (9 pages).
(Continued)

*Primary Examiner* — Binh Q Tran
(74) *Attorney, Agent, or Firm* — Todd R. Fronek; Larkin Hoffman Daly & Lindgren Ltd.

(57) ABSTRACT

A pump assembly includes a centrifugal pump having an intake, a discharge, a pump chamber and an impeller to deliver water from the intake to the discharge. A priming system is fluidly coupled to the pump chamber. A drive assembly includes a drive shaft coupled to the priming system and positioned around an impeller shaft coupled to the impeller for selective rotatable coupling of the impeller shaft and the drive shaft.

20 Claims, 19 Drawing Sheets

(51) Int. Cl.
*F04D 9/04* (2006.01)
*F04D 29/42* (2006.01)

(56) References Cited

U.S. PATENT DOCUMENTS

| | | | | |
|---|---|---|---|---|
| 2,750,894 | A * | 6/1956 | Thomas | F04D 29/061 415/111 |
| 2,961,968 | A * | 11/1960 | Hill | F04D 9/042 415/102 |
| 2,995,092 | A | 8/1961 | Thomas et al. | |
| 3,091,182 | A | 5/1963 | Anderson et al. | |
| 3,191,539 | A | 6/1965 | Davenport | |
| 3,416,456 | A | 12/1968 | Pollak et al. | |
| 3,558,236 | A | 1/1971 | Bylsma | |
| 4,183,721 | A | 1/1980 | Peterson | |
| 4,295,792 | A * | 10/1981 | Tachibana | F04D 25/02 192/48.614 |
| 5,649,425 | A * | 7/1997 | Matsumura | F01K 25/10 60/648 |
| 5,704,774 | A | 1/1998 | Rha | |
| 6,305,169 | B1 * | 10/2001 | Mallof | F01D 15/10 60/608 |
| 6,585,493 | B2 * | 7/2003 | Sutton | F04D 9/041 417/199.2 |
| 6,588,381 | B2 * | 7/2003 | Komorowski | F01L 1/02 123/198 C |
| 6,682,313 | B1 | 1/2004 | Sulmone | |
| 6,692,234 | B2 * | 2/2004 | Muhs | B01D 21/0012 417/199.2 |
| 6,863,035 | B2 * | 3/2005 | Komorowski | F01L 1/02 123/41.44 |
| 8,613,605 | B2 * | 12/2013 | Hammar | F04D 29/4273 415/119 |
| 9,080,503 | B2 * | 7/2015 | Buschur | F02B 37/10 |
| 2011/0142610 | A1 | 6/2011 | Burgess et al. | |

FOREIGN PATENT DOCUMENTS

| | | | |
|---|---|---|---|
| CN | 2301566 | Y | 12/1998 |
| CN | 2360641 | Y | 1/2000 |
| CN | 2412112 | Y | 12/2000 |
| CN | 2547916 | Y | 4/2003 |
| DE | 1276449 | | 8/1968 |
| DE | 3825651 | A1 | 2/1989 |
| EP | 1191228 | A2 | 3/2002 |
| EP | 1 495 773 | A2 | 1/2005 |
| GB | 29261 | | 0/1910 |
| GB | 190929261 | A | 0/1910 |
| GB | 871991 | | 7/1961 |

OTHER PUBLICATIONS

CN Second Office Action, Jul. 27, 2016, pp. 1-7.

* cited by examiner

INTEGRATED RECIPROCATING PRIMER DRIVE ARRANGEMENT

CROSS-REFERENCE TO RELATED APPLICATION

This application claims priority under 35 U.S.C. §119(e) to U.S. Provisional Patent Application Ser. No. 61/622,752 filed on Apr. 11, 2012, and incorporated herein by reference.

BACKGROUND

Priming systems are used to prime centrifugal fire pumps so as to reduce air pressure within an interior of the centrifugal pump. During priming, water is pushed by atmospheric pressure from a water source to the pump. Once water reaches the pump, the pump is able to provide continuous water flow and increase the pressure of the water without the aid of the priming system. In particular, the pump includes an impeller driven by a rotatable impeller shaft to deliver water from a pump intake to a pump discharge.

Current priming systems for centrifugal fire pumps include vane primers, piston primers, diaphragm primers and water ring primers. In some current implementations, the priming system draws power from the impeller shaft to prime the pump. In particular, an eccentric drive converts rotational motion from the impeller shaft to linear motion so as to increase water within the pump. To this end, a mechanism is utilized to engage and disengage priming systems from the impeller shaft. In one approach, a pump discharge pressure is monitored to physically engage and disengage the priming system based on water pressure within the discharge of the pump. Another approach involves housing the priming system remotely from the pump and driving the priming system by a belt or other suitable mechanical connection mechanism. Using this approach, the connection mechanism from the impeller shaft to the remote priming system is engaged and disengaged either by a clutch or by physically moving the priming system with respect to the connection mechanism.

For priming systems that rely on pump discharge pressure to engage/disengage the centrifugal pump, leakage through the priming system after the pump is primed can occur. To prevent leakage, an auxiliary mechanism is provided in order to control flow from the pump discharge to the priming system. The auxiliary mechanism increases cost and complexity to the priming system.

For priming systems that are remotely mounted and coupled to the pump, a separate housing for the priming system occupies space and increases complexity as the priming system needs separate accommodations within the truck. Additionally, the drive mechanism connecting the priming system with the centrifugal pump can generate noise and require guarding.

SUMMARY OF THE INVENTION

A pump assembly includes a centrifugal pump, a priming system and a drive assembly. The centrifugal pump includes an intake, a discharge, a pump chamber and an impeller to deliver water from the intake to the discharge. A priming system is fluidly coupled to the pump chamber to remove air from the pump chamber so as to prime the pump. The drive assembly includes an impeller shaft coupled to the impeller to rotate therewith and a drive shaft positioned around the impeller shaft to drive the priming system.

A method of priming a centrifugal pump includes providing a drive assembly including an impeller shaft, a drive shaft and a clutch assembly. The impeller shaft is rotated and the clutch assembly is engaged such that the drive shaft rotates with the impeller shaft. A priming system coupled with the drive shaft is operated to remove air from the centrifugal pump.

DETAILED DESCRIPTION

Figure 2:
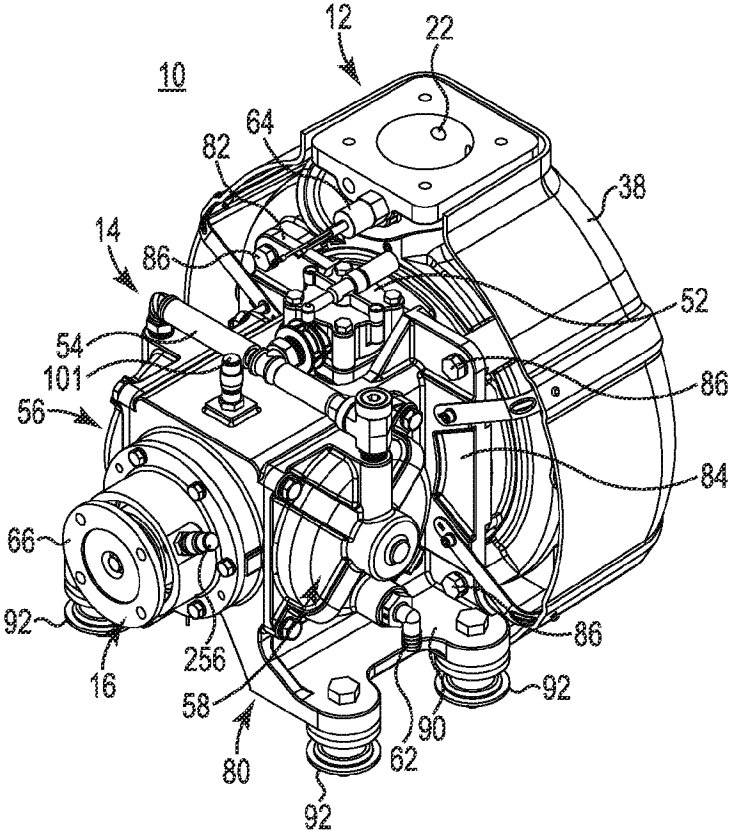
FIG. 2 is a rear isometric view of the pump assembly illustrated in FIG. 1.
Figure 1:
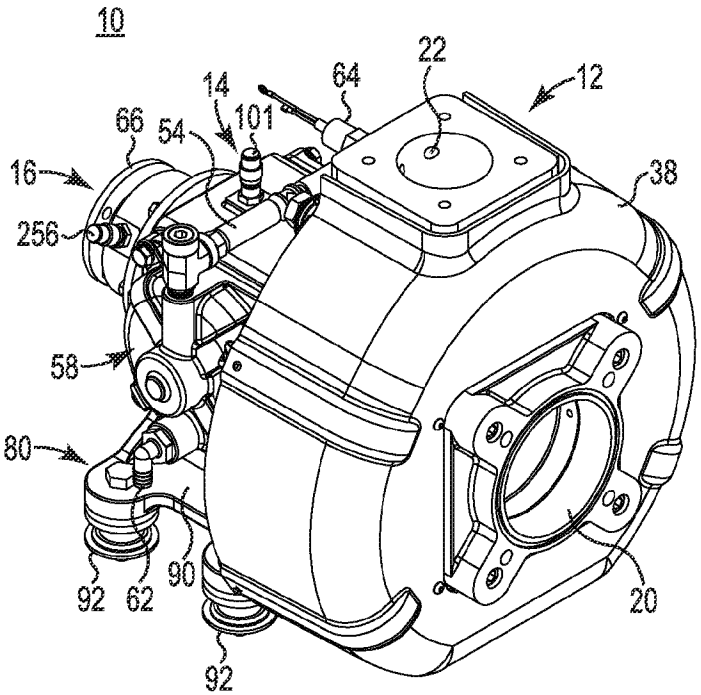
FIG. 1 is a front isometric view of a pump assembly.

FIGS. 1 and 2 are isometric views of a pump assembly 10 including a centrifugal pump (generally indicated at 12), a priming system (generally indicated at 14) and a drive assembly (generally indicated at 16). The priming system 14 is fluidly coupled to the pump 12 so as to prime pump 12 by removing air from the pump 12. Drive assembly 16 is coupleable to both the pump 12 and priming system 14 to provide rotational power thereto. As discussed in more detail below, the drive assembly 16 provides rotational power to the pump 12 so as to deliver water from a pump intake 20 to a pump discharge 22. Additionally, drive assembly 16 is selectively coupleable to the priming system 14 through a clutch assembly such that, when the drive assembly 16 is coupled to the priming system 14, air within the pump 12 is replaced with water so as to prime the pump 12. Once pump 12 is primed, the drive assembly 16 can be disengaged from the priming system 14 and continue to operate pump 12.

Figure 3:
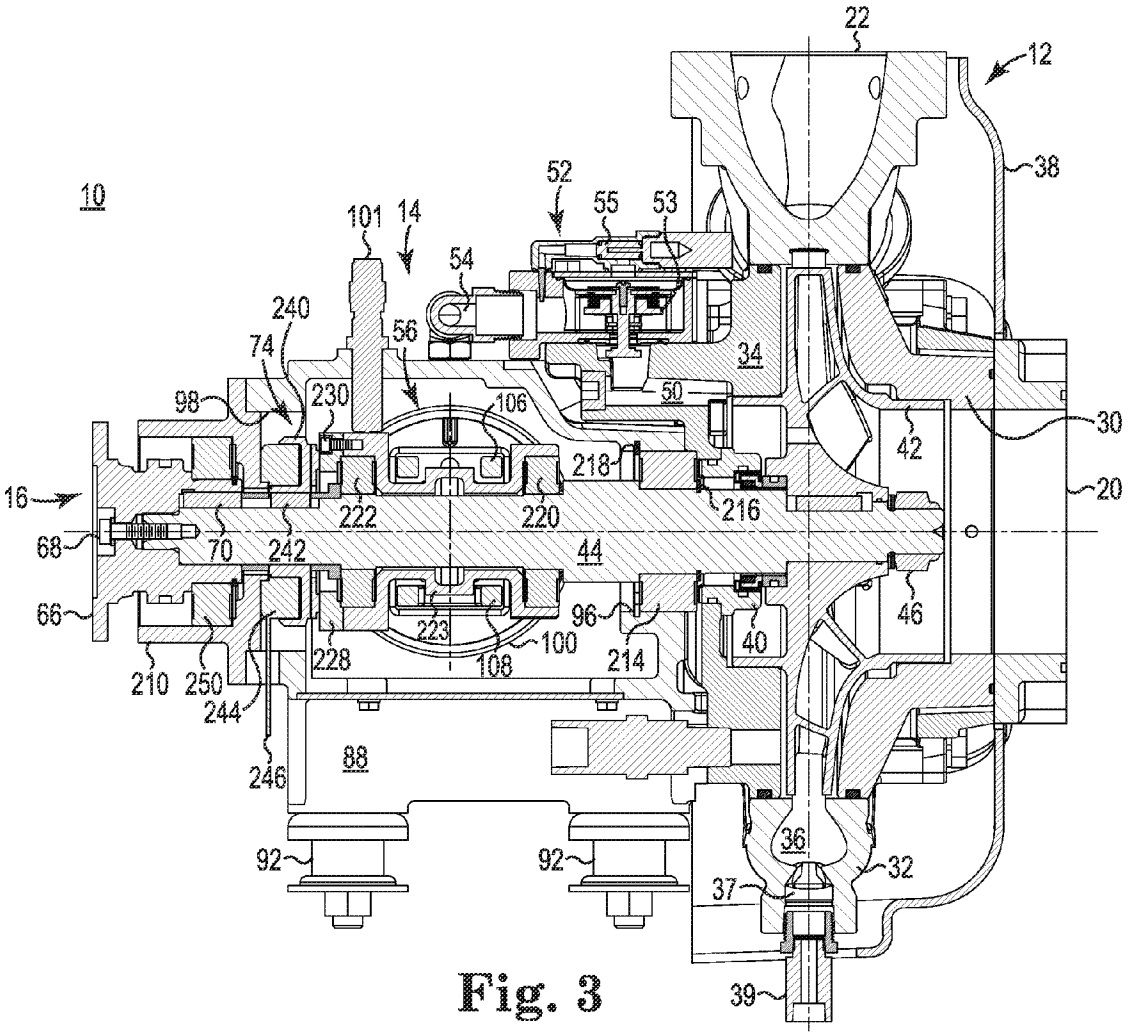
FIG. 3 is a side sectional view of the pump assembly illustrated in FIG. 1.
Figure 4:
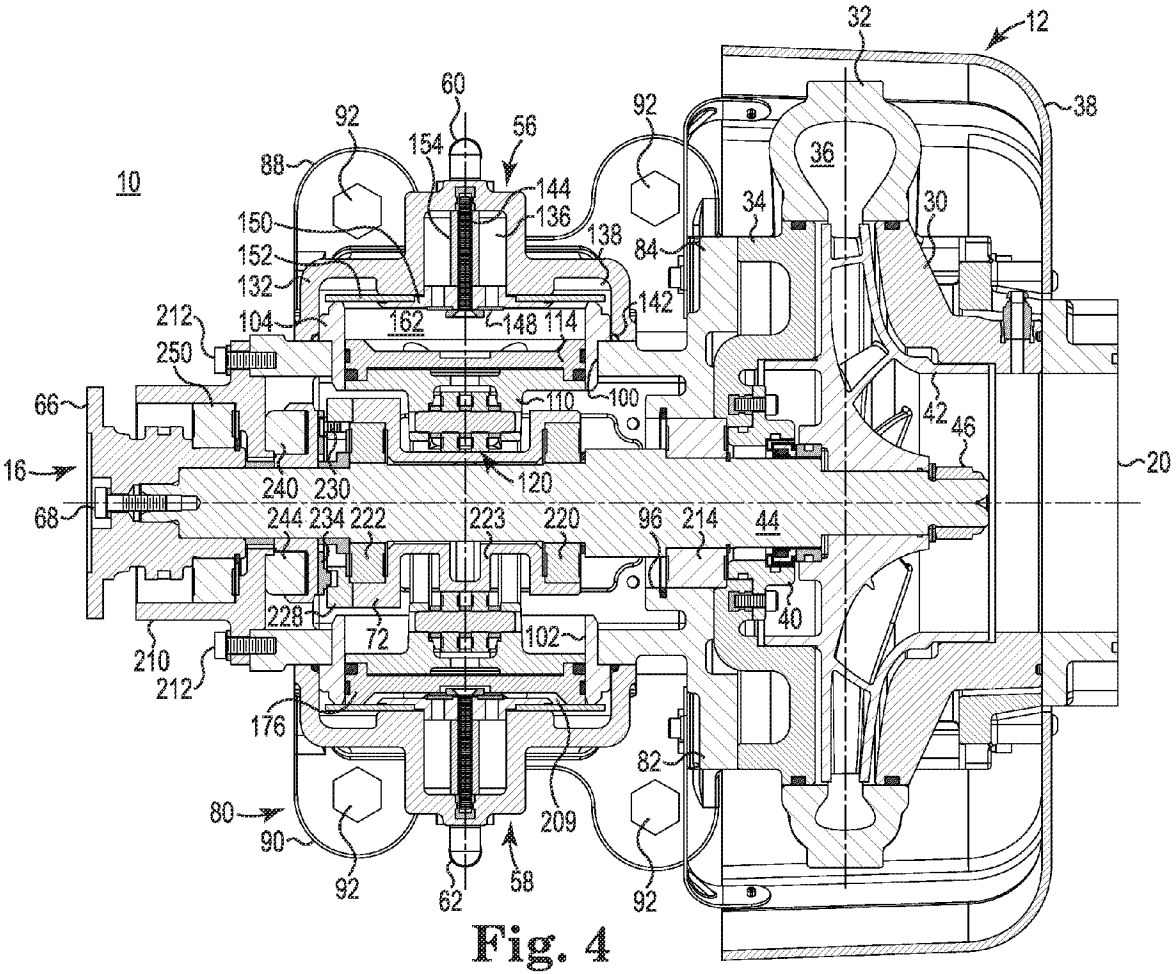
FIG. 4 is a top sectional view of the pump assembly illustrated in FIG. 1.
Figure 5:
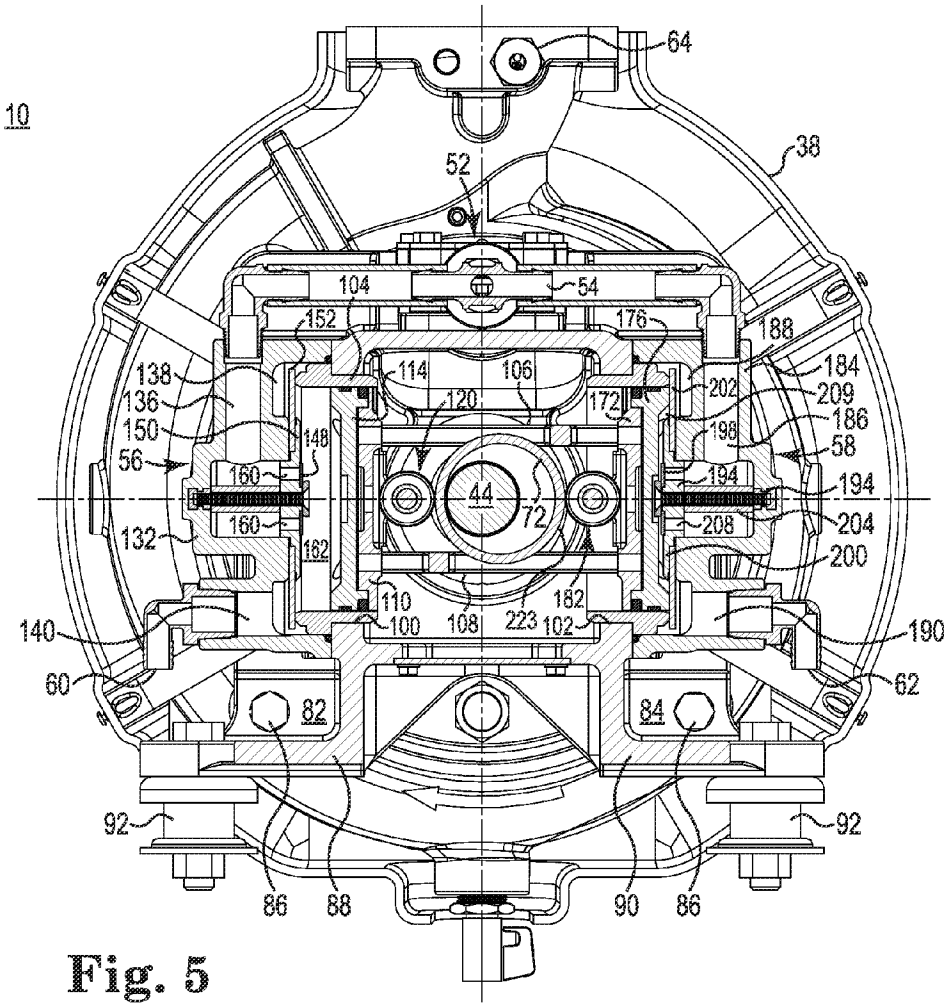
FIG. 5 is a rear sectional view of the pump assembly illustrated in FIG. 1.

With additional reference to sectional views of pump assembly 10 in FIGS. 3-5, pump 12 includes an intake housing 30, a volute housing 32 and an impeller support housing 34. Collectively, the intake housing 30, volute housing 32 and impeller support housing 34 define a pump chamber 36. As shown in FIG. 3, the volute housing 32 also defines a drain port 37 and an associated cap 39 to allow pump chamber 36 to be drained. Additionally, pump 12 includes a shroud 38 mounted to the intake housing 30 and a collar 40 mounted to the impeller support housing 32. In order to deliver water from the intake 20 to the discharge 22, an impeller 42 is positioned within the pump chamber 36 and mounted to an impeller shaft 44 of drive assembly 16 with a suitable fastener 46 (herein embodied as a nut). Collar 40 includes a mechanical seal assembly that prevents leakage from the pump interior past the rotatable impeller shaft 44 relative to the stationary impeller support housing 34. During operation of the drive assembly 16, impeller shaft 44 and impeller 46 rotate such that impeller 46 delivers water from intake 20 to discharge 22.

Priming system 14, as best illustrated in FIG. 3, includes a passageway 50 fluidly coupled with the pump chamber 36. During operation, priming system 14 delivers air from the pump chamber 36 through passageway 50 and to a priming valve 52. When priming valve 52 is in an open configuration due to a valve assembly 53 being in an open position (as illustrated in FIG. 3), air is allowed to pass from pump chamber 36 to passageway 50, through priming valve 52 and into a T-shaped conduit 54. Once prime of pump 12 has occurred, priming valve 52 can transition to a closed configuration (not shown), wherein passageway 50 is fluidly isolated from conduit 54.

In one embodiment, one example priming valve 52 is described in U.S. patent application Ser. No. 13/599,646, entitled "Priming Valve System for Pre-Priming Centrifugal Pump Intakes," filed Aug. 30, 2012, the contents of which are attached hereto. In this embodiment, a solenoid valve 55 can open to atmospheric pressure such that air above valve assembly 53 is at atmospheric pressure. Due to a pressure differential between atmospheric pressure and vacuum pressure in conduit 54 created by operation of the priming system 14, this differential provides suitable pressure to open valve assembly 53 within priming valve 52 such that air can pass from passageway 50 to conduit 54. In other embodiments, solenoid valve 55 can be eliminated such that air above valve assembly remains at atmospheric pressure. In any event, passageway 50 is vertically displaced (i.e., lower) than valve 52 and conduit 54. As such, gravity assists in preventing water from entering priming system 14 through passageway 50 and valve 52.

As best illustrated in FIG. 5, conduit 54 is in turn fluidly coupled with piston assemblies 56 and 58, which operate to discharge air through respective outlets 60 and 62, as discussed in more detail below. In discharging air through outlets 60 and 62, water is delivered from a water source (e.g., a tank, a pond) to the intake 20 and into the pump chamber 36. Once water is positioned within the pump 12 so as to achieve a desired pressure at discharge 22, the pump 12 is primed and operation of pump 12 can continuously deliver water without the aid of priming system 14. To this end, one or more pressure sensors 64 can be coupled to discharge 22 (or alternatively other positions within pump 12) to provide an indication that water pressure in pump 12 has reached a desired level and that pump 12 is primed. This indication provided by the pressure sensor 64 can be used to disengage clutch assembly 74. It should further be noted that in the event water enters piston assemblies 56 and 58 through conduit 54, the water can also be discharged through outlets 60 and 62 with assistance of gravity since the outlets 60 and 62 are positioned lower than the conduit 54.

Drive assembly 16 includes a drive input member 66 directly coupled to a motor (not shown) such as a fire truck engine to provide rotational power thereto. In turn, the drive input member 66 is directly coupled to the impeller shaft 44 through a fastener 68 and square key 70. Additionally, the impeller shaft 44 is selectively coupled to an eccentric drive shaft 72 for rotation with the impeller shaft 44 through a clutch assembly 74. In particular, the impeller shaft 44 is selectively coupleable to the eccentric drive shaft 72 to operate priming system 14 in order to evacuate air from the pump chamber 36. During operation of the priming system 14, the clutch assembly 74 is engaged such that the eccentric drive shaft 72 rotates with the impeller drive shaft 44. During rotation of eccentric drive shaft 72, the eccentric drive shaft 72 engages each of the piston assemblies 56 and 58, which operate to deliver air from the pump chamber 36, through passageway 50, conduit 54 and out the outlets 60 and 62. The piston assemblies 56 and 58 are coupled to one another about the drive shaft 72 to operate in a reciprocating manner. Due to the reciprocating movement, one of the piston assemblies is in an extended position (i.e., expelling air through its respective outlet) while the other piston assembly is in a retracted position (i.e., drawing air from conduit 54). Once pump 12 is primed, the clutch assembly 74 is disengaged such that rotation of drive shaft 72 is stopped (and thus stopping operation of priming system 14) whereas rotation of impeller 42 continues independent of rotation of drive shaft 72.

Figure 6:
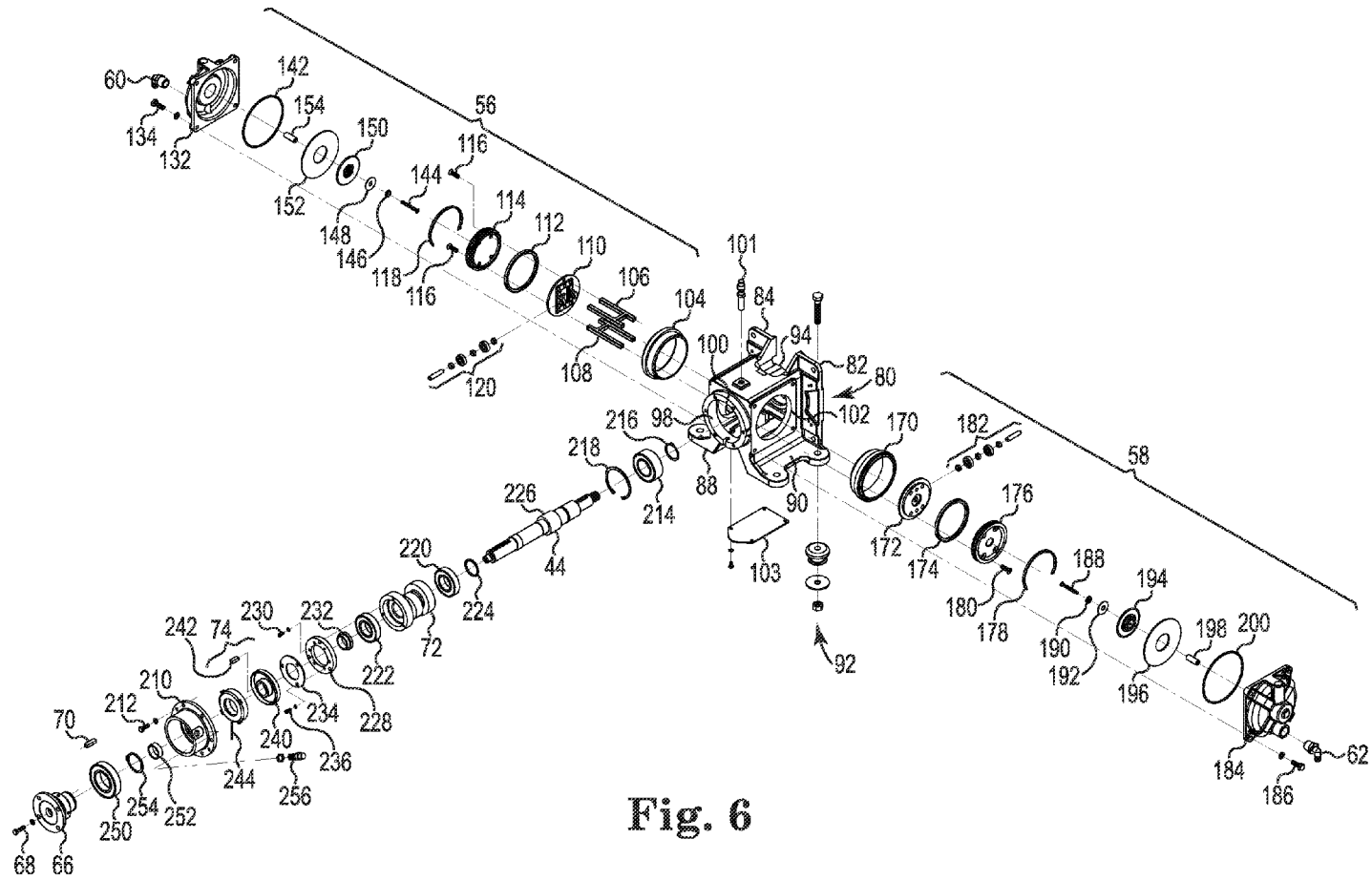
FIG. 6 is an exploded view of a priming system and a drive assembly of the pump assembly illustrated in FIG. 1.
Figure 7:
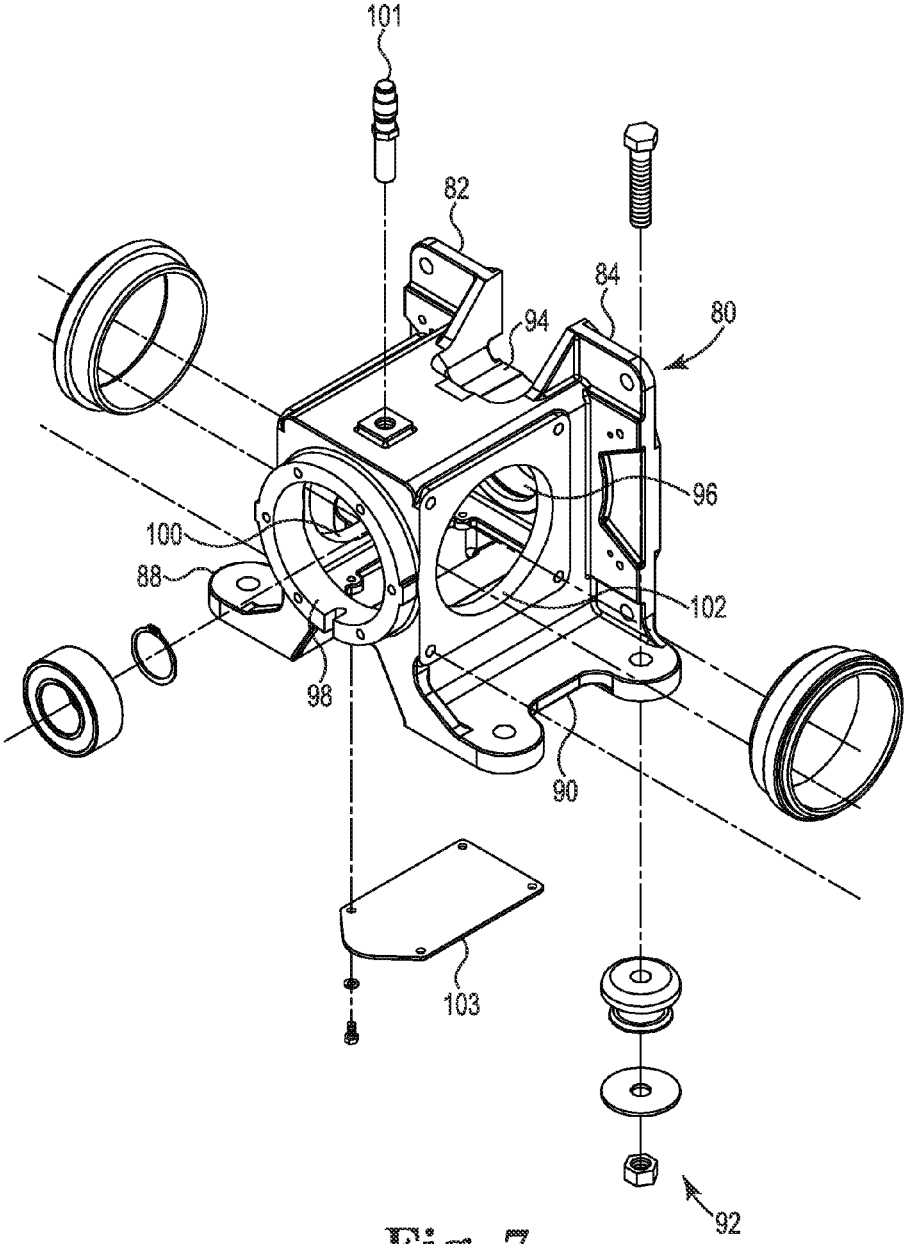
FIG. 7 is a close-up exploded view of a pedestal body illustrated in FIG. 6.
Figure 8A:
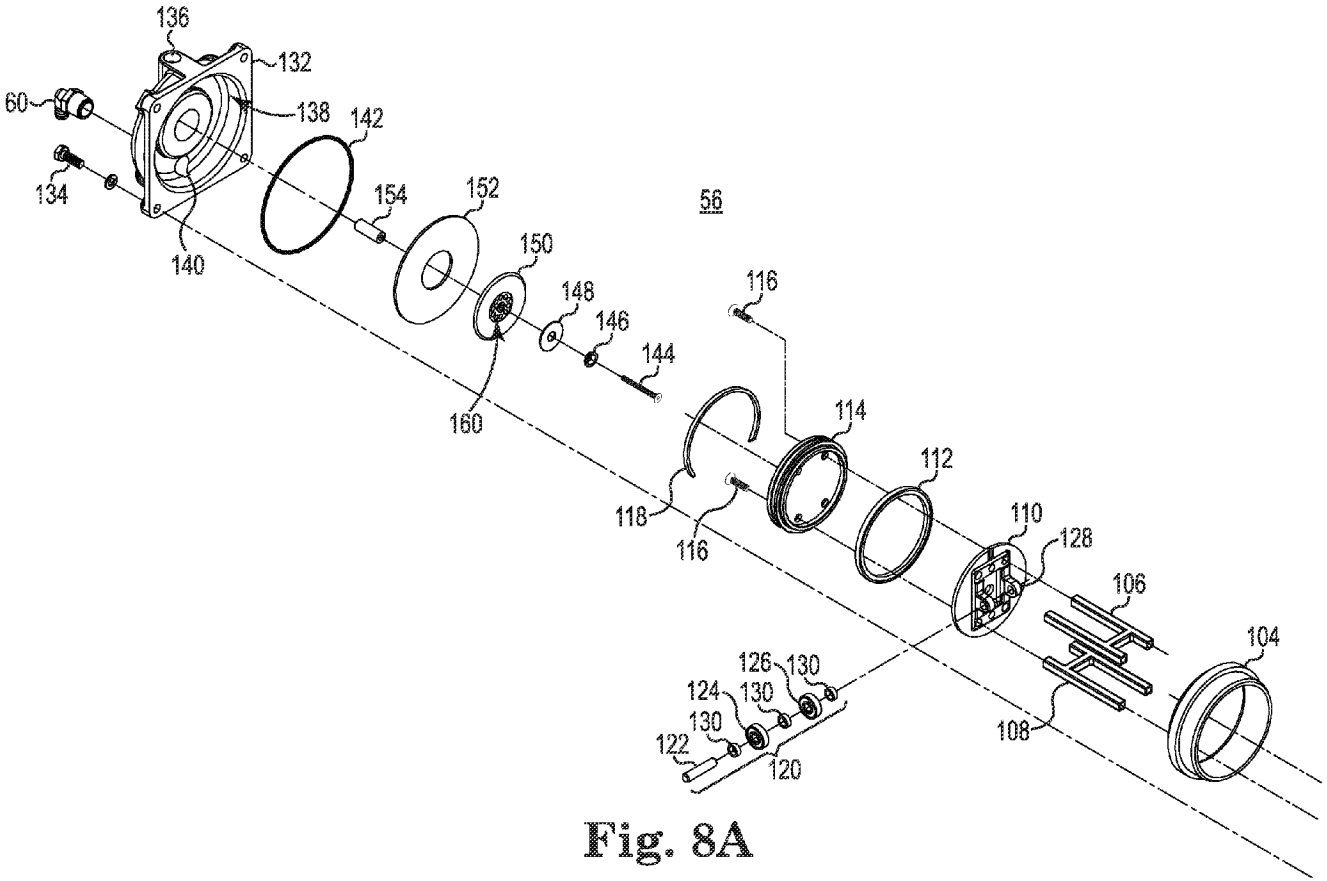
FIG. 8A is a close-up exploded view of a first piston assembly illustrated in FIG. 6.
Figure 8B:
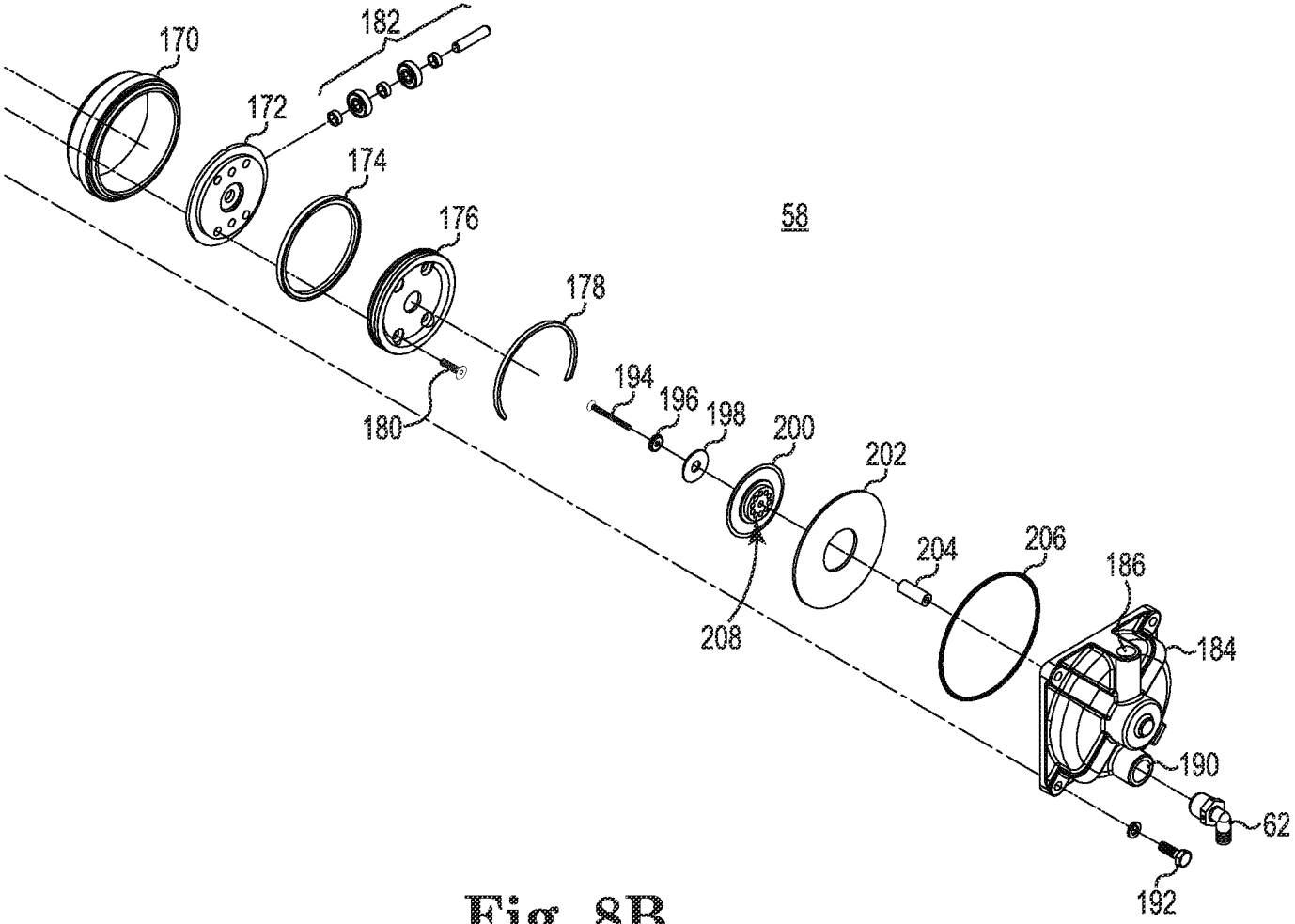
FIG. 8B is a close-up exploded view of a second piston assembly illustrated in FIG. 6.
Figure 9A:
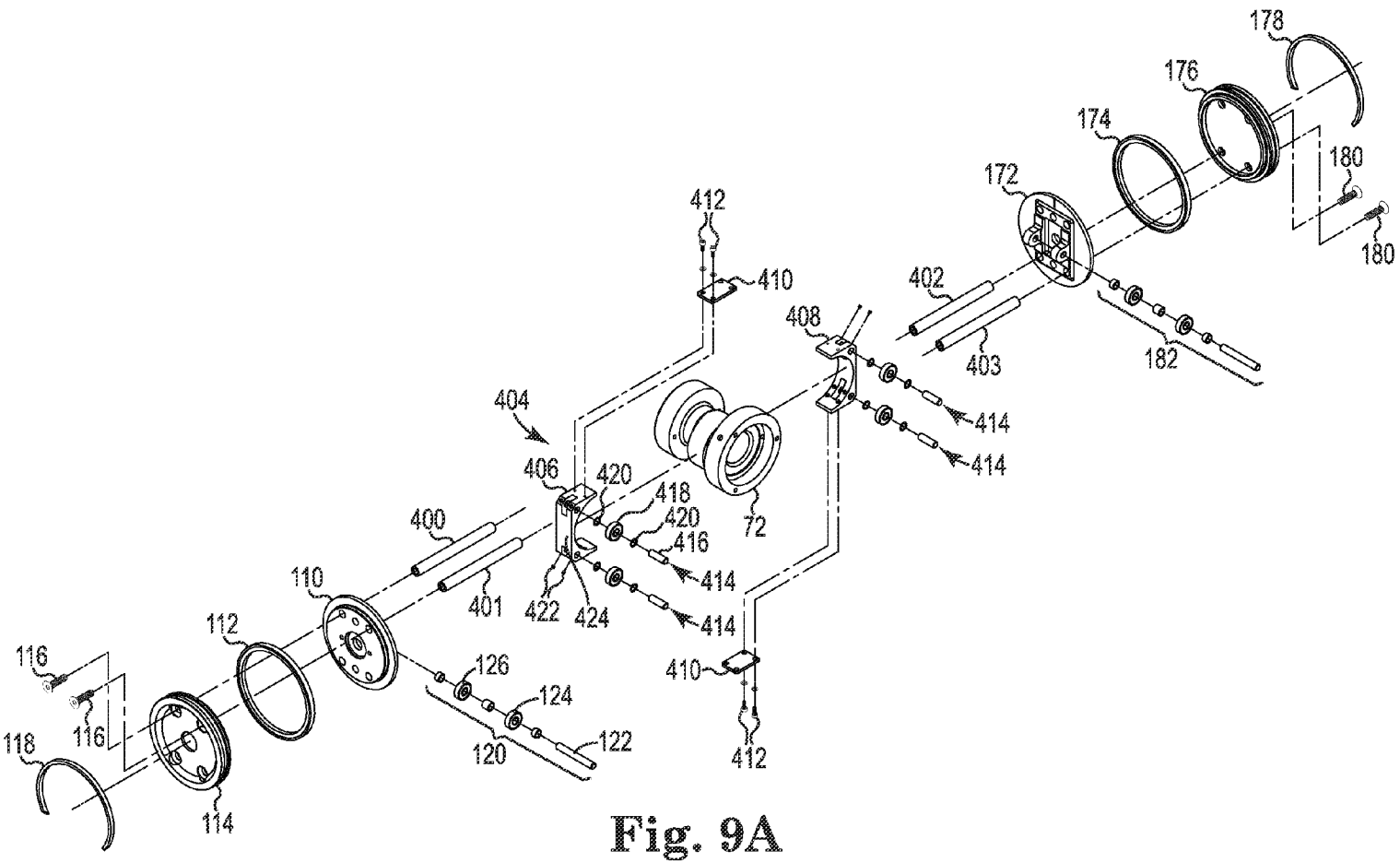
FIGS. 9A-9C are close-up exploded views of alternative connection mechanisms to connect the piston assemblies illustrated in FIGS. 8A and 8B.
Figure 9B:
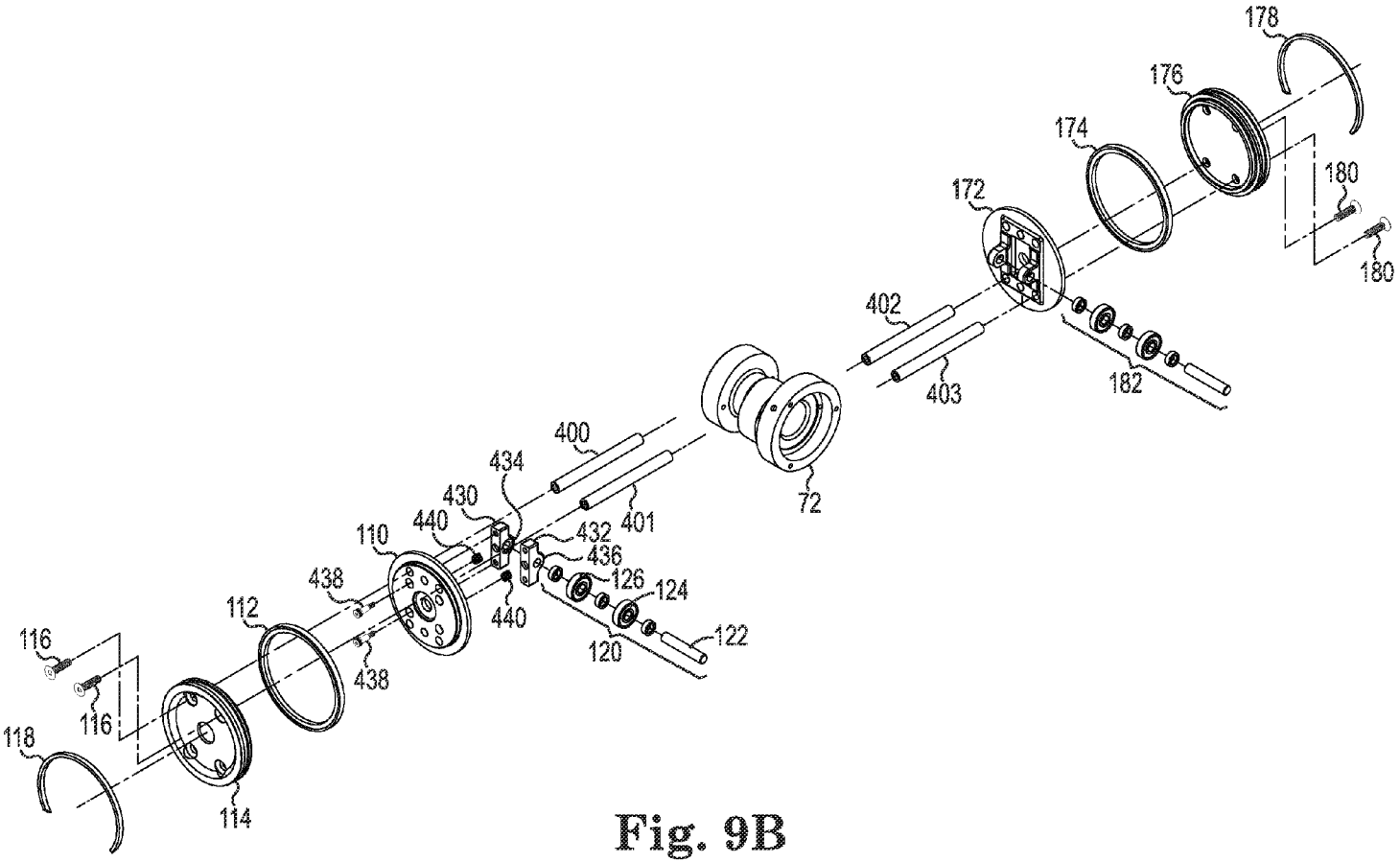
Figure 9C:
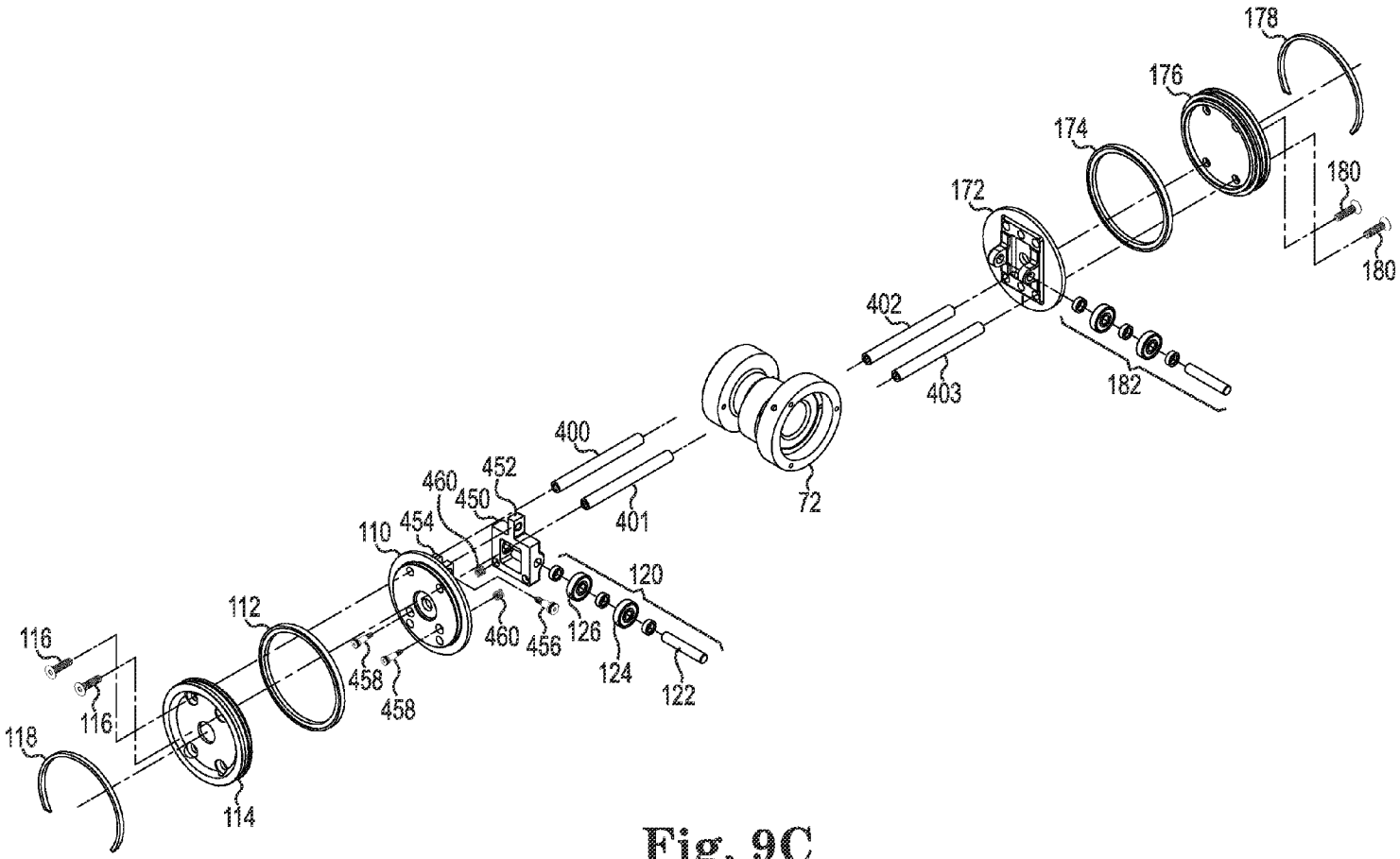
Figure 10:
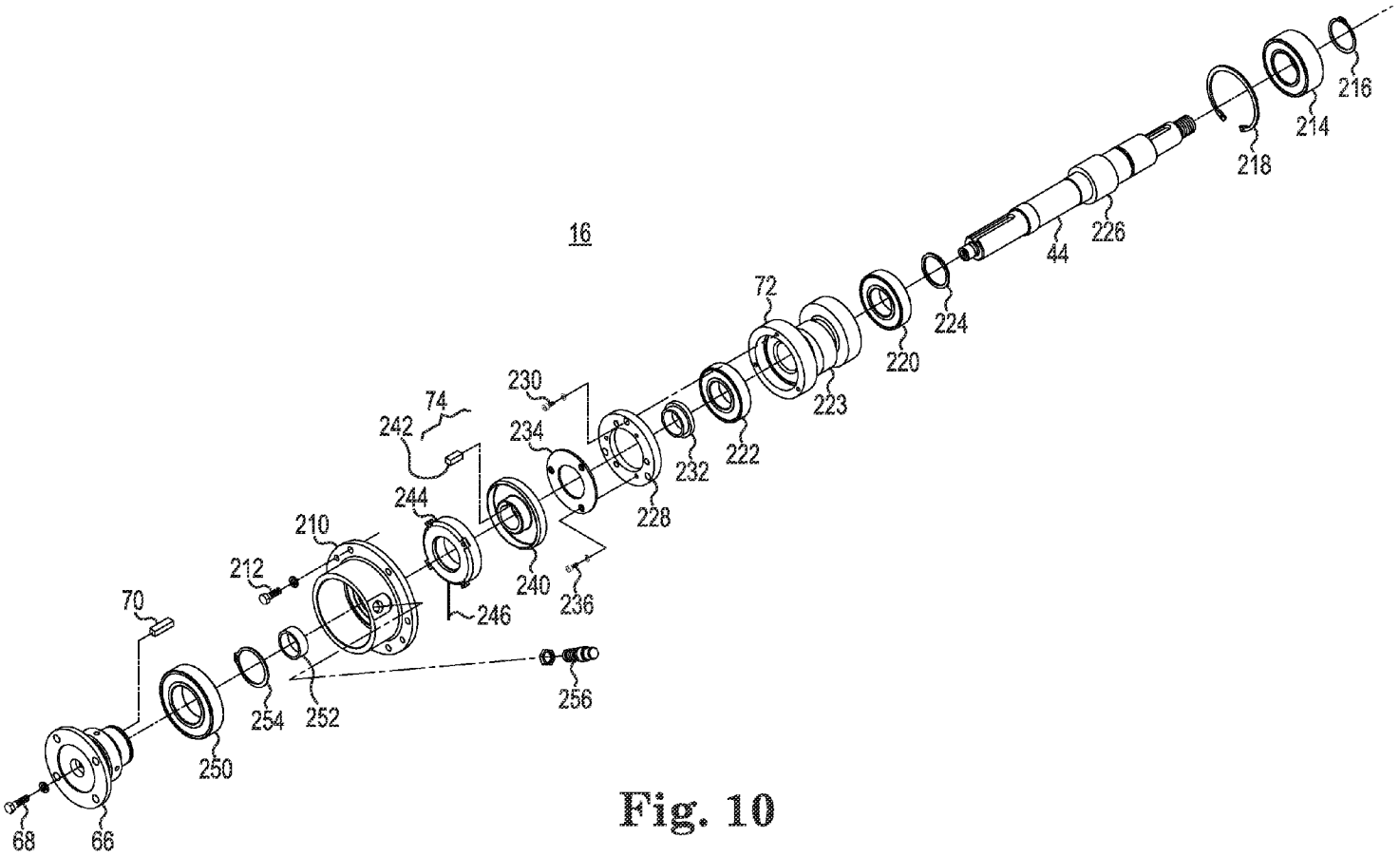
FIG. 10 is a close-up exploded view of a drive assembly illustrated in FIG. 6.

With additional reference to FIGS. 6-10, pump 12, priming system 14 and drive assembly 16 are coupled together through a main pedestal body 80, a close-up of which is illustrated in FIG. 7. The pedestal body 80 defines first and second front mounting flanges 82 and 84 for mounting the pump 12 thereto with fasteners 86 (see FIGS. 2 and 5), as well as first and second lower legs 88 and 90 for mounting pump assembly 10 to a fire truck, for example with a plurality of vibration mounting fastener assemblies 92. Additionally, body 80 defines an upper recess 94 for receiving priming valve 52, front and rear apertures 96 and 98 for receiving and supporting rotation of impeller shaft 44 and side apertures 100 and 102 for receiving piston assemblies 56 and 58, respectively. Close-up illustrations of piston assemblies 56 and 58 are shown in FIGS. 8A and 8B, respectively. Alternative connection mechanisms are illustrated in FIGS. 9A-9C to connect piston assembly 56 to piston assembly 58. Drive assembly 16, as discussed below in relation to FIG. 10, is positioned within the front and rear apertures 96 and 98. A rotational sensor (e.g., a magnetic pick-up) 101 is mounted to pedestal body 80 and is further positioned so as to sense a rotational speed of drive shaft 72 (see FIG. 3) and provide a signal indicative of the speed. A cover plate 103 is further mounted to a bottom of the pedestal body 80 so as to prevent unwanted contaminants front entering an interior of the body 80.

With reference to FIGS. 6 and 8A, piston assembly 56 includes a cylinder 104 positioned within side aperture 100 of pedestal body 80. First and second H rods 106 and 108 are further positioned within body 80 and provide support to the piston assemblies 56 and 58. In particular, the H rods 106 and 108 tie the piston assemblies 56 and 58 together to provide reciprocating movement of the piston assemblies 56 and 58 during operation of the priming system 14. Piston assembly 56 further includes a piston body 110, a piston seal 112 and a piston head 114. Fasteners 116 (two are shown, whereas four are used in this embodiment) secure the piston head 114, piston seal 112 and piston body 110 to the H rods 106 and 108. A wear band 118 is further coupled to the piston head 114. Additionally, a bearing interface assembly 120 is coupled with the piston body 110 to interface with the eccentric drive shaft 72.

As illustrated in FIG. 8A, the bearing interface assembly 120 includes a shaft 122 that supports first and second bearings 124 and 126 relative to a mounting bracket 128 positioned on a side of the piston body 110. The bearing interface assembly 120 further includes spacers 130 for providing separation of the bearings 124 and 126 from one another and from the bracket 128. In one embodiment, bearings 124 and 126 can be formed of at least partially (or completely) a suitably resilient elastomer such as polyurethane to provide damping of impact between the bearings 124, 126 and drive shaft 72. In one embodiment, bearings 124, 126 are coated with polyurethane. Alternatively, or in addition, spacers 130 can be at least partially (or completely) formed of an elastomer (e.g., polyurethane) and include an outer diameter that is slightly larger than an outer diameter of the bearings 124, 126 so as to also dampen the impact between drive shaft 72 and the bearing interface assembly 120.

Piston assembly 56 further includes a piston cover 132 secured to body 80 through a plurality of fasteners 134 (one shown in FIG. 8A, four in total). Piston cover 132 defines an inlet passageway 136, an annular cavity 138 and an outlet passageway 140. An o-ring 142 is provided to seal piston cover 132 against pedestal body 80 and cylinder 104. Additionally, secured to the piston cover 132 with a fastener 144 and washer 146 include a small diaphragm 148, a diaphragm retainer 150, a large diaphragm 152 and a spacer 154. Retainer 150 includes a plurality of passages 160 positioned therein to allow air to flow from inlet passageway 136 to annular cavity 138.

Upon coupling of the piston assembly 56 to the pedestal body 80 and as illustrated in FIG. 5, a piston cavity 162 is formed between piston head 114 and large diaphragm 152. During operation of piston assembly 56, as piston head 114 moves away from large diaphragm 152 (as illustrated in FIG. 5) air flows from passageway 136, through passages 160 and into piston cavity 162, due to deflection of small diaphragm 148 caused by pressure differential between inlet passageway 136 and piston cavity 162. As piston head 114 moves toward large diaphragm 152, diaphragm 152 deflects such that air can move from piston cavity 162 to outlet passageway 140, ultimately exiting air outlet 60. As such, an air flow path through piston assembly 56 is provided on a single side of the piston head 114.

Turning to FIGS. 6 and 8B, piston assembly 58 is similarly configured to piston assembly 56 and includes a cylinder 170 positioned within aperture 102, a piston body 172, a piston seal 174, a piston head 176 and wear band 178. Moreover, piston assembly 58 includes fasteners 180 (one of which is shown, four in total) to secure the piston body 172, piston seal 174 and piston head 176 to the H rods 106 and 108. Piston assembly 58 also includes a bearing interface assembly 182 configured to interface with the eccentric drive shaft 72 and similar in construction to bearing interface assembly 120. As discussed above, components of the bearing interface assembly 182 may include polyurethane to dampen impact between assembly 182 and drive shaft 72. Piston assembly 58 further includes a piston cover 184 defining an inlet passageway 186, an annular cavity 188 (FIG. 5) and an outlet passageway 190. The piston cover 184 is secured to pedestal body 80 with a plurality of fasteners 192 (one shown in FIG. 8B, four in total). Similar to piston assembly 56, piston assembly 58 also includes a fastener 194 and washer 196 that secure a small diaphragm 198, a diaphragm retainer 200, a large diaphragm 202 and a spacer 204 to the piston cover 184. An o-ring 206 provides a seal between piston cover 184 and pedestal body 80. A plurality of passages 208 are provided within diaphragm retainer 200.

Upon coupling of the piston assembly 58 to the pedestal body 80 and as illustrated in FIG. 5, a piston cavity 209 is formed between the piston head 176 and the large diaphragm 202. During operation of piston assembly 58, as piston head 176 moves away from large diaphragm 202, air flows from passageway 186 through passages 208 and into piston cavity 209 upon deflection of small diaphragm 198. When piston head 176 is forced in a direction toward large diaphragm 202 (as illustrated in FIG. 5), large diaphragm 202 deflects, allowing air to pass from piston cavity 209 to outlet passageway 190 and exit outlet 62. As such, an air flow path through piston assembly 58 is provided on a single side of the piston head 176.

FIGS. 9A-9C illustrate alternative connection mechanisms for use in connecting piston assemblies 56 and 58. These connection mechanisms can be useful in damping forces and reducing noise caused by drive shaft 72 contacting the piston assemblies 56 and 58. As illustrated in FIG. 9A, tie rods 400-403 replace H-rods 106 and 108 to provide direct connection between piston body 110 and piston body 172. The tie rods 400-403 are secured to the piston bodies 110, 172 through fasteners 116 and 180. A planetary drive 404 surrounds drive shaft 72 and is positioned to dampen forces and reduce noise between drive shaft 72 and piston bodies 110 and 172. Planetary drive 404 includes two planetary blocks 406 and 408 positioned on either side of shaft 72. The blocks 406 and 408 are connected together with corresponding brackets 410 and fasteners 412. Each block 406, 408 maintains two bearing assemblies 414 that directly engage the drive shaft 72. Each bearing assembly 414 includes a pin 416, a bearing 418 and washers 420 positioned on either side of the bearing 418. Set screws 422 hold pin 416 in place within the blocks 406, 408. Upon final assembly, planetary drive 404 directly contacts bearing interface assemblies 120 and 182 (e.g., in particular bearings 124 and 126 of assembly 120). As drive shaft 72 rotates during operation, planetary drive 404 travels in a circular path (when viewed along a rotational axis of drive shaft 72). An exterior face (e.g., face 424 of block 406) moves in a vertical manner along bearings 124 and 126. Eccentric output of drive shaft 72 imparts a linear force on piston body 110. Block 408 operates in a similar manner. In an alternative embodiment, planetary drive 404 can be formed of a single block.

In an alternative approach to connection piston assemblies 56 and 58, FIG. 9B illustrates follower blocks 430 and 432 that can be coupled to either piston body 110 or piston body 172 in order two dampen forces and reduce noise due to contact of draft shaft 72 with bearing interface assembly 120 (or assembly 182). Follower blocks 430 and 432 receive the bearing interface assembly 120 and in particular include apertures 434 and 436, respectively, to receive pin 122 of bearing interface assembly 120. Blocks 430 and 432 are mounted to piston body 110 using a plurality of shoulder bolts 438. Shoulder bolts 438 allow for limited relative movement between the blocks 430, 432 and piston body 110. Additionally, each of the blocks includes a compression spring 440 positioned between the respective block and the piston body 110. The compression springs 440 bias the blocks 430 and 432 away from piston body 110 such that bearing interface assembly 120 can maintain contact with drive shaft 72 during a complete rotation of drive shaft 72.

FIG. 9C illustrates a similar arrangement to FIG. 9B and includes a hinged block 450 positioned between shaft 72 and piston body 110. Block 450 includes a projection 452 that is coupled with a corresponding bracket 454 on piston body 110. In particular, a bolt 456 couples the projection 452 with the bracket 454 on piston body 110. Lower shoulder bolts 458 are configured to secure block 450 to the piston head 110 opposite the projection 452 and allow limited relevant movement of the block 450 with respect to the piston body 110. Compression springs 460 are positioned to dampen forces placed on bearing assembly 120 and block 450 from drive shaft 72.

FIG. 10 illustrates components of drive assembly 16 coupled to pedestal body 80. With additional reference to FIG. 6, a bearing housing 210 is secured to the body 80 using a plurality of fasteners 212 to support the drive assembly 16. A front bearing 214 is positioned within aperture 96 to support the impeller shaft 44 and allow rotation of impeller shaft 44 with respect to the body 80. A first retaining ring 216 retains impeller shaft 44 relative to the bearing 214, which abuts a shoulder 226 on impeller shaft 44. Additionally, a second retaining ring 218 positions bearing 214 within aperture 96 as further illustrated in FIG. 4. First and second intermediate bearings 220 and 222 are positioned around the impeller shaft 44 and allow rotation of the impeller shaft 44 with respect to eccentric drive shaft 72. Drive shaft 72 includes a central eccentric portion 223 (e.g., elliptically shaped) to engage bearing interface assemblies 120 and 182. Additionally, a wave spring 224 is positioned between shoulder 226 on the impeller shaft 44 and bearing 220 to locate the bearing 220. A cover plate 228 is secured to eccentric drive shaft 72 with a plurality of fasteners 230, which secure bearing 222 and a spacer 232 to eccentric drive shaft 72. In turn, a clutch armature disc 234 is secured to the cover plate 228 with a plurality of fasteners 236.

Clutch assembly 74 includes a clutch rotor hub 240 coupled to the impeller shaft 44 through a square key 242 such that the rotor hub 240 rotates with impeller shaft 44. Clutch assembly 74 further includes an electromagnetic clutch coil carrier 244 that includes an input 246. Although clutch assembly 74 is illustrated as being electromagnetic, other types of clutches can further be utilized. To engage clutch assembly 74, input 246 carries a signal to energize clutch coil carrier 244. Once carrier 244 is energized, disc 234 is brought into engagement with rotor hub 240 through electromagnetic force such that disc 234 (and thus drive shaft 72) rotates with hub 240 and impeller shaft 44. When clutch assembly 74 disengages (due to input 246 no longer energizing coil 244), disc 234 separates from hub 240 and impeller shaft 44 rotates independent of drive shaft 72.

Rotation of drive input member 66 is supported through a bearing 250 positioned within bearing housing 210. A spacer 252 and retaining ring 254 help to locate bearing 250 within bearing housing 210. In addition, a rotational sensor (e.g., a tachometer) 256 is mounted to the bearing support housing 210 so as to sense a rotational speed of drive member 66 (and thus impeller shaft 44) and provide a signal indicative of the speed.

During operation of pump assembly 10, pump 12 is primed by priming system 14 in order to bring water into the pump chamber 36. To operate priming system 14, a signal is sent through input 246 to engage clutch assembly 74 by energizing coil 244. At this time, rotational power is provided to drive input member 66 and impeller shaft 44 so as to rotate impeller 42. Additionally, as clutch assembly 74 is engaged, eccentric drive shaft 72 rotates so as to provide reciprocal movement of piston heads 114 and 176 due to rotation of eccentric portion 223 contacting and driving respective bearing interface assemblies 120 and 182. As best illustrated in FIGS. 4 and 5, the eccentric portion 223 of drive shaft 72 engages the bearing interface assemblies 120 and 182 so as to extend and retract the piston heads 114 and 172. Additionally, direct connection of the piston heads 114 and 176 through H rods 106 and 108 (or tie rods 400-403) can provide stability and direct reciprocal movement.

In FIGS. 4 and 5, piston head 114 is illustrated in a retracted position, whereas piston head 176 is illustrated in an extended position. As such, piston cavity 162 is shown to hold a larger volume of air compared to piston cavity 209. In the retracted position of piston head 114, air is allowed to transfer from inlet passageway 136 to piston cavity 162. Alternatively, in the extended position of piston head 176, air is forced out of piston cavity 209 to outlet passageway 190 and ultimately to outlet 62. Upon rotation 180° of eccentric portion 233, piston head 114 is forced to the extended position, whereas piston head 176 is forced to the retracted position. As a result, upon extension and retraction of piston heads 114 and 176, priming system 14 operates to reduce pressure in conduit 54 (i.e., creating a vacuum), which opens priming valve 52 and serves to transfer air from the pump chamber 36 through conduit 54 and out the outlets 60 and 62. Once pressure in the pump chamber 36 reaches a desired level (e.g., as sensed by pressure sensor 64) clutch assembly 74 can be disengaged such that pump 12 can operate without the assistance of priming system 14.

Alternatively, or in addition to, the relative rotational speeds of drive input member 66 and drive shaft 72 can be monitored via tachometer 256 and magnetic pickup 101 so as to determine whether pump 12 is primed. For example, if drive shaft 72 is rotating at a speed slower than drive input member 66, this slower speed can indicate that drive shaft 72 is pumping water rather than air, due to the increased power required to pump water. Upon determining that drive shaft 72 is rotating at a slower speed than drive member 66 based on signals provided by pickup 101 and tachometer 256, clutch assembly 74 can be disengaged. As such, excessive wear of the clutch assembly 74 can be avoided. At this point, priming valve 52 transitions to a closed configuration such that water is prevented from entering conduit 54.

A control system (not shown) can be coupled to the pickup 101 and tachometer 256 to monitor the respective speeds of the impeller shaft 44 and drive shaft 72 to determine if pump 12 is primed. The control system can further be configured to control rotation of the drive assembly 16 (for example through connection to the fire engine motor), the priming valve 52 and/or the clutch assembly 74. One example control system is described in U.S. patent application Ser. No. 13/673,524, filed Nov. 9, 2012, and entitled, "Proportional Dynamic Ratio Control For Compressed Air Foam Delivery", the contents of which are attached hereto.

Another feature that can be provided within pump assembly 10 is a purging system that operates to remove residual water from priming system 10. One mechanism to remove water from priming system 14 is to fluidly connect the priming system 14 to atmosphere (rather than to passageway 50) and operate the priming system 14 for a period of time to remove any residual water from within the priming system 14. In one example, conduit 54 can be coupled to a purge valve or auxiliary valve (not shown) that is similar in construction to priming valve 52. Instead of being selectively coupled to passageway 50, the purge valve can selectively couple conduit 54 to atmosphere (e.g., through use of a valve assembly and a solenoid valve similar to valve assembly 53 and solenoid valve 55 discussed above) during operation of the priming system 14.

Priming system 14 can be operated for a period of time such that air from atmosphere can pass through conduit 54, into the piston assemblies 56, 58 and out the outlets 60, 62, causing any residual water to further be removed from priming system 14. When not in operation, the purge valve transitions to a closed configuration such that air does not pass through the purge valve to the priming system 14. Alternatively, the purge valve can only include a solenoid valve directly coupled to conduit 54 so as to couple the conduit to atmosphere. In another embodiment, priming system 14 can be coupled to a source of compressed air to force any water out of the outlets 60 and 62. Regardless of its exact configuration, a purge system can remove residual water from priming system 14 in order to reduce corrosion and enhance performance of the priming system 14.

Figure 11:
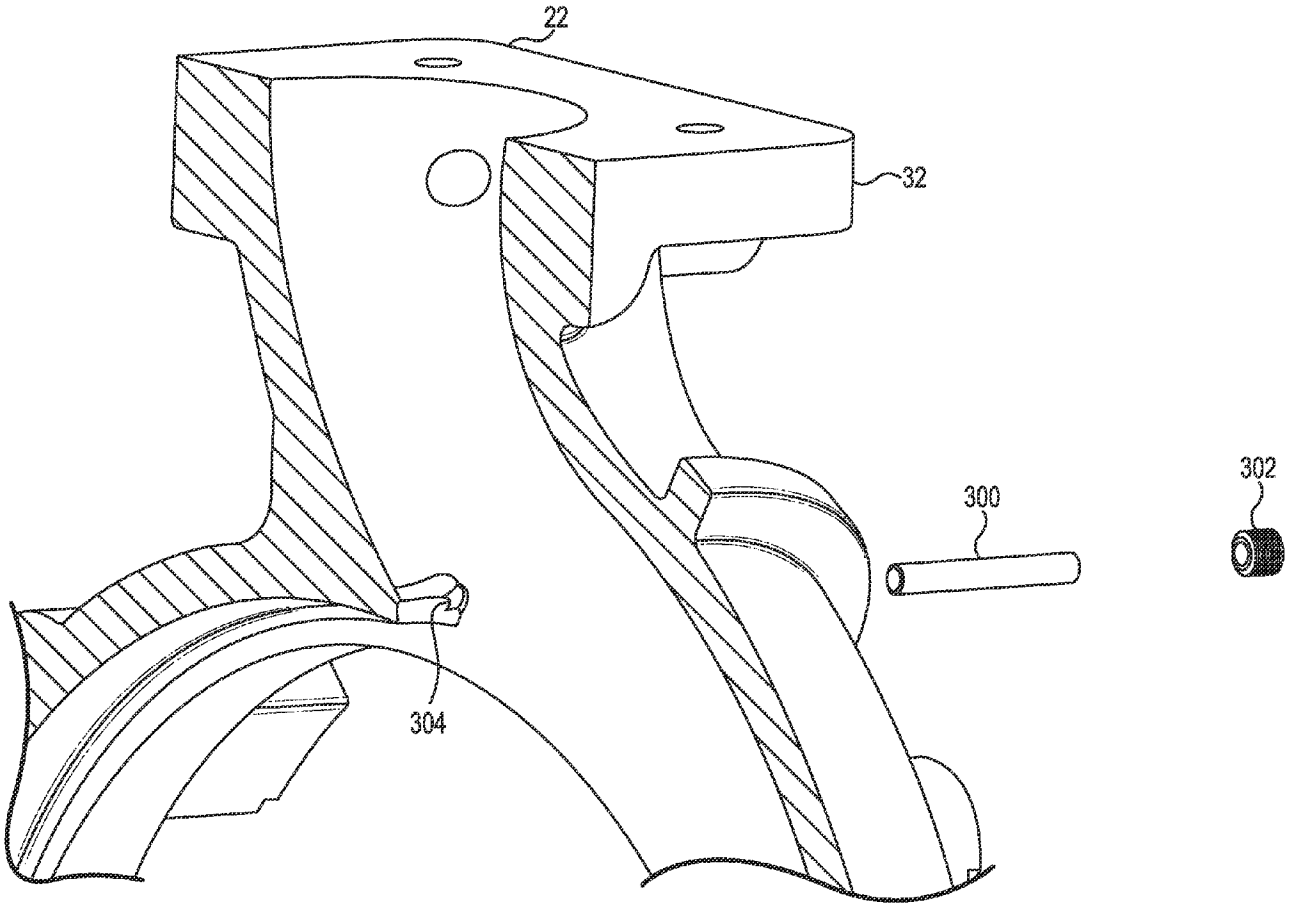
FIGS. 11-14 are different views of a reinforcement element coupled to a volute housing of a centrifugal pump.
Figure 12:
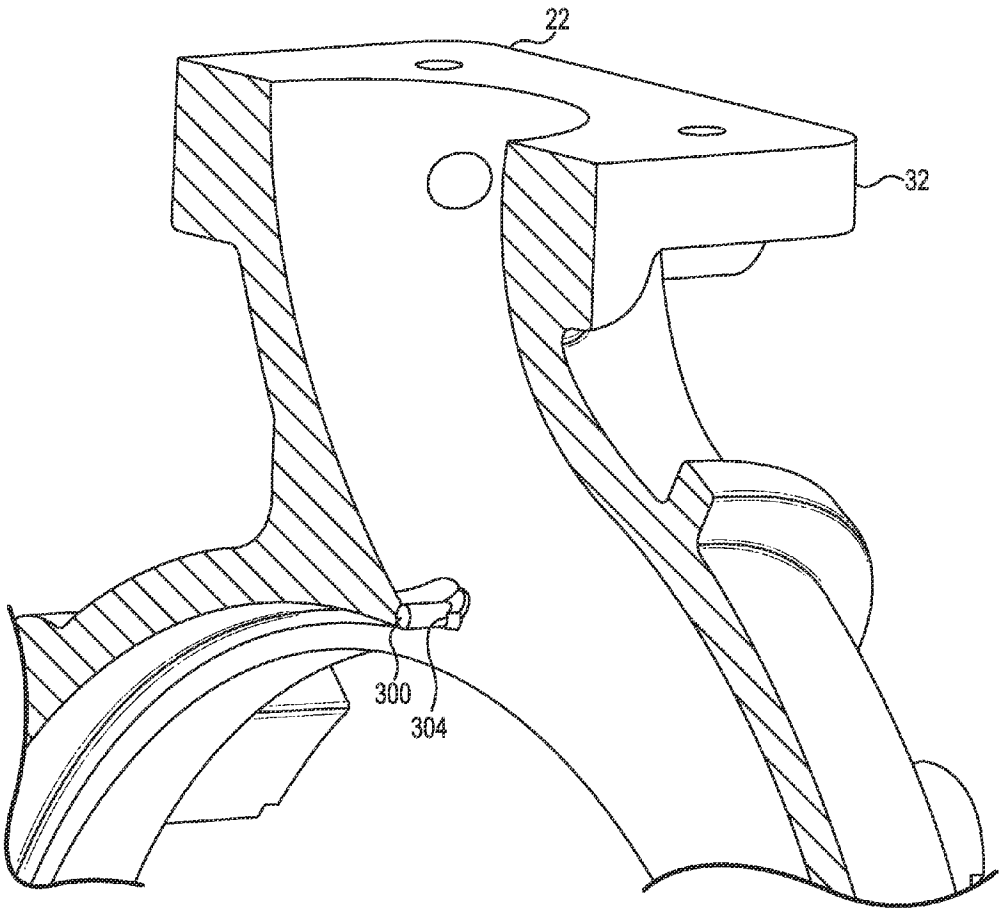
Figure 13:
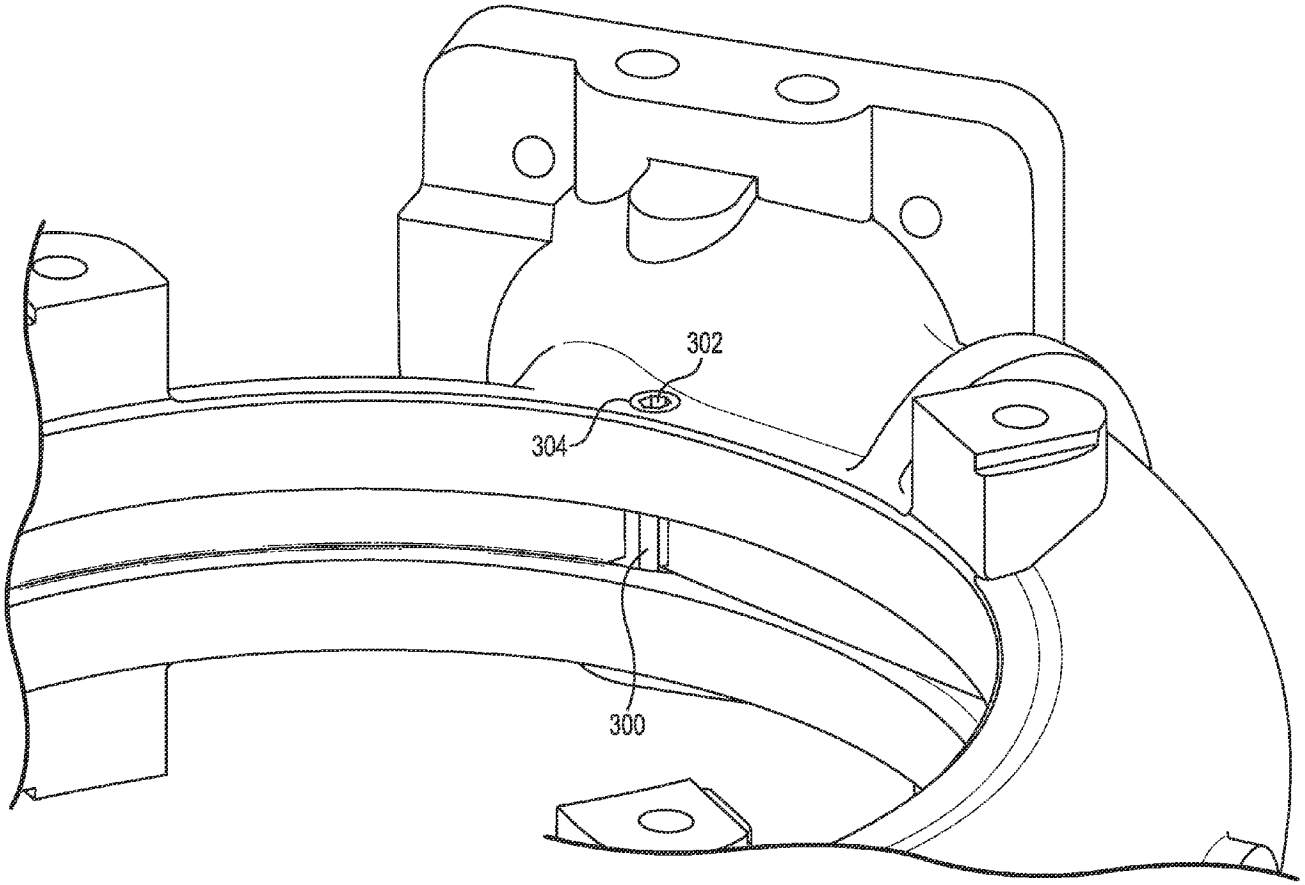
Figure 14:
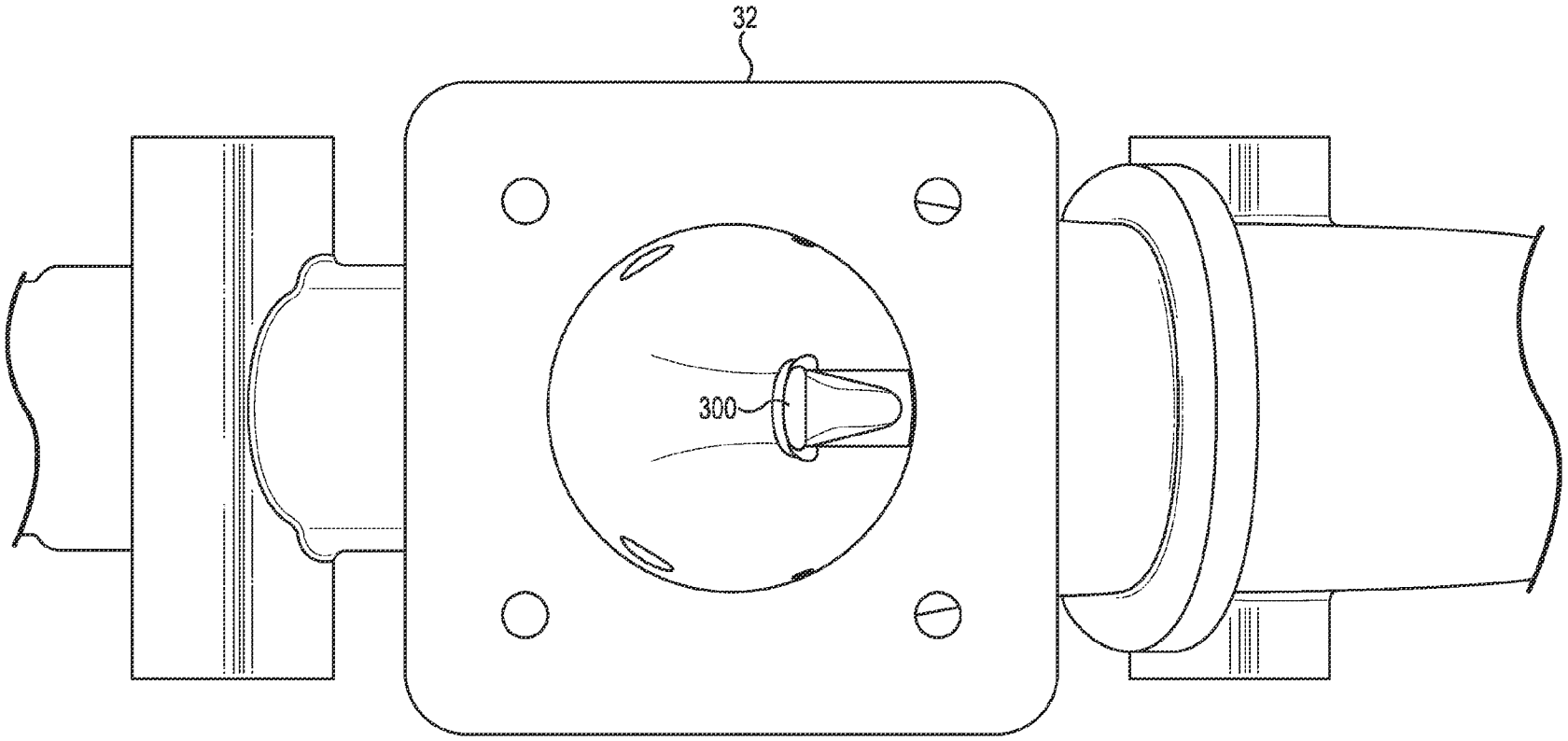

Yet another feature useful with pump assembly 10 is a stripping edge (also known as a cutwater) reinforcement for the pump 12. As is known, the stripping edge is a portion of a centrifugal pump that diverts water expelled by the impeller to the discharge of the pump and, as such, is subject to suitable wear. FIGS. 11-14 illustrate different views of volute housing 32 with an exemplary reinforcement element 300 that serves as the stripping edge. As illustrated, the reinforcement element 300 is positioned within the volute housing 32 and secured to housing 32 with a suitable fastener 302. As illustrated in FIG. 11, volute housing 32 includes an elongated aperture 304 that receives the reinforcement element 300. FIGS. 12-14 illustrate reinforcement element 300 secured within the volute housing 32.

Although the reinforcement element 300 is herein embodied as a cylindrical pin, element 300 can take various forms. For example, the element 300 may be triangular in cross section, elliptical in cross section, square in cross section or other shapes as desired. Additionally, the element 300 need not be formed of a unitary piece of material and thus be formed of multiple pieces. The reinforcement element 300 can further be formed of a variety of different materials as desired. In one embodiment, the material selected for element 300 exhibits high strength and is resistant to corrosion, abrasion, erosion and/or combinations thereof. Example materials include stainless steel, titanium, satellite, or materials that exhibit one or more similar properties. Reinforcement element 300 can be used to reduce damage to the volute housing 32 and thus lead to a longer life of pump 12. Additionally, reinforcement member 300 is replaceable such that element 300 may be replaced after wear as necessary.

Figure 15:
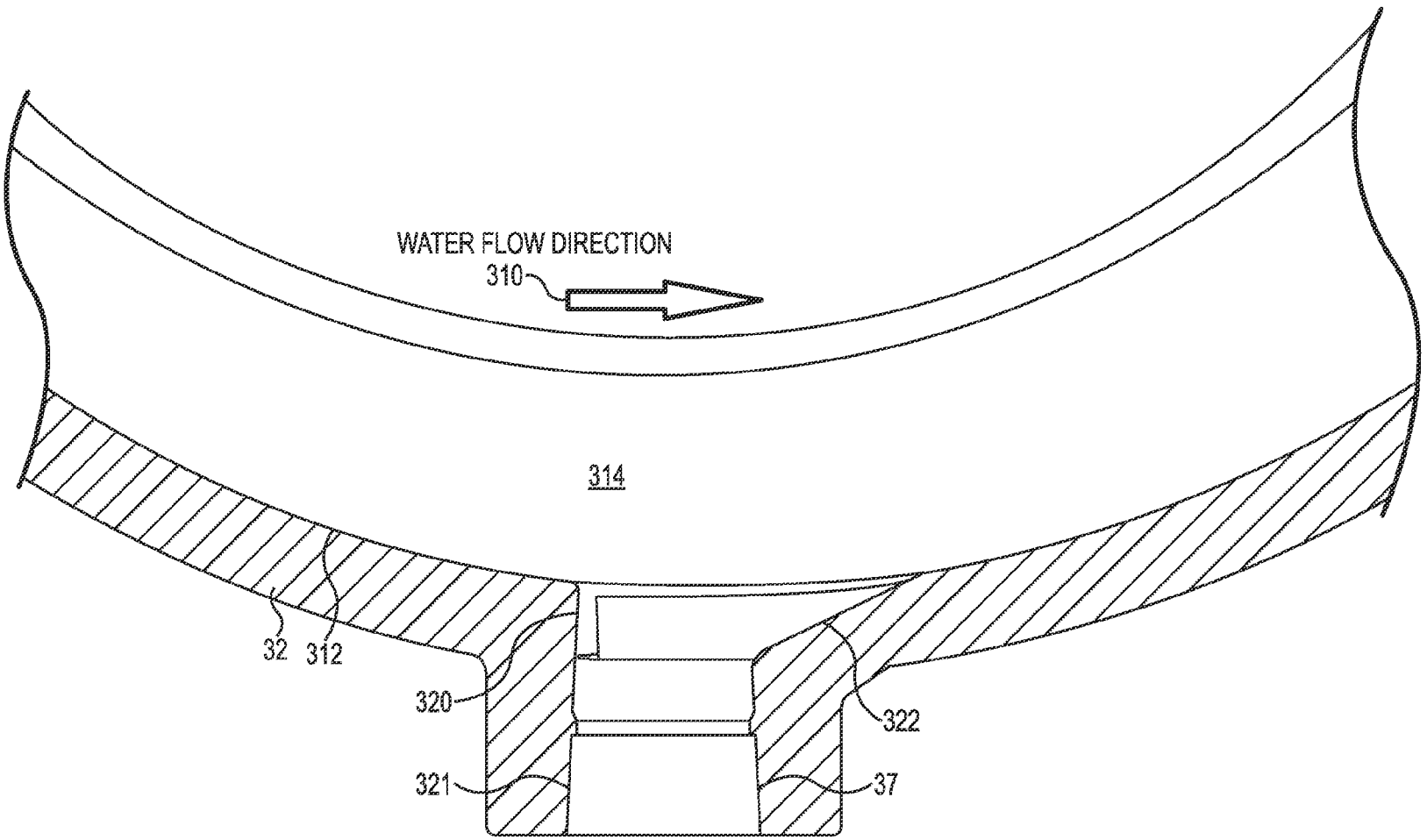
FIGS. 15-17 are different views of a drain port positioned within a volute housing of a centrifugal pump.
Figure 16:
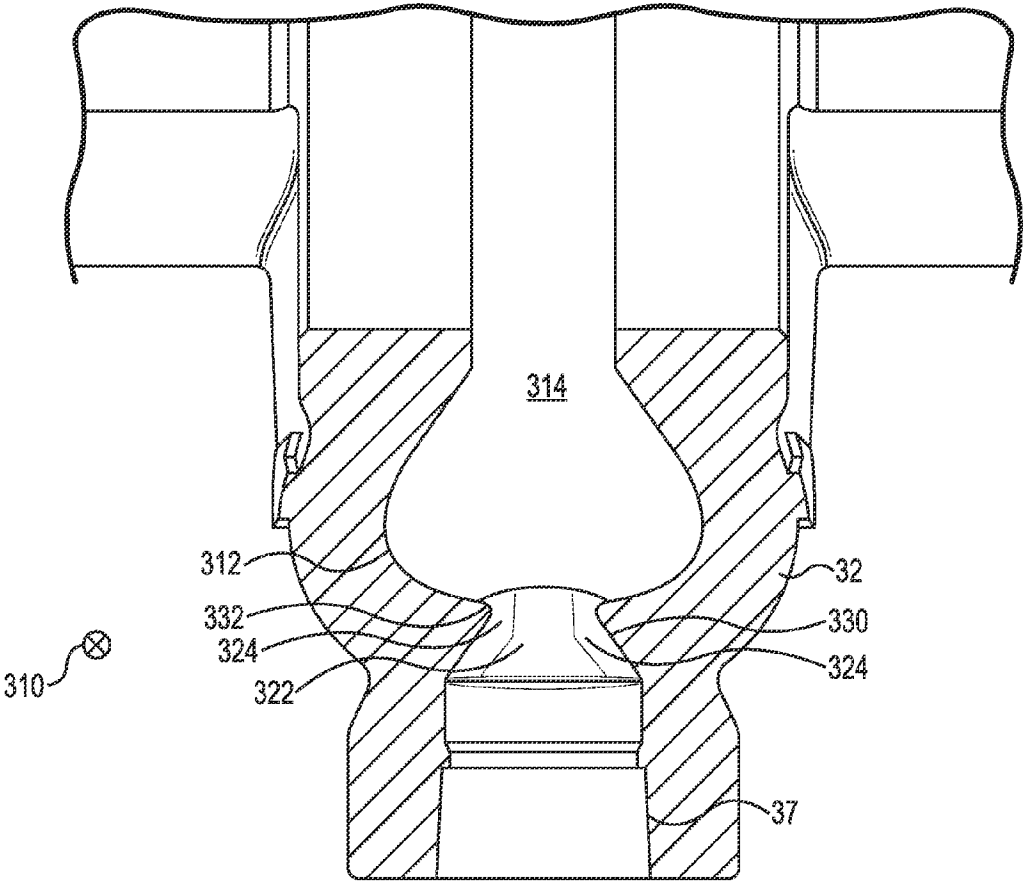
Figure 17:
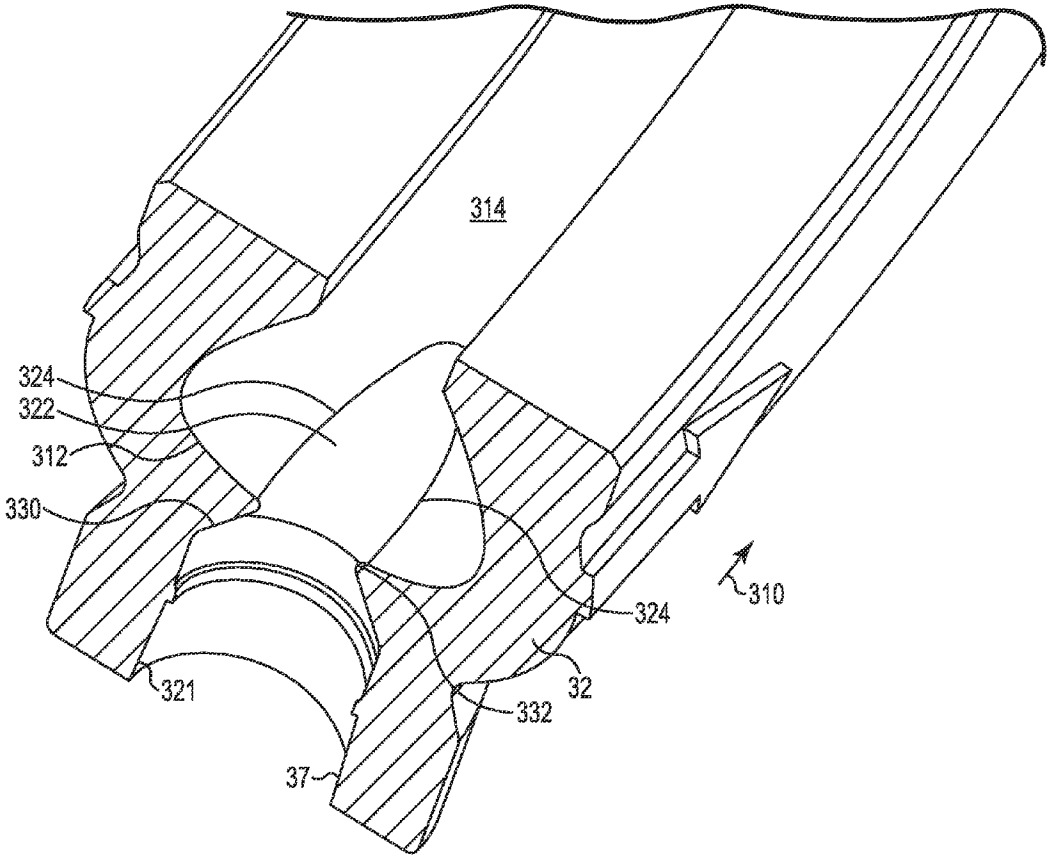

Yet another feature useful with pump assembly 10 is a configuration of drain port 37 on the volute housing 32. FIGS. 15-17 illustrate one exemplary configuration of drain port 37. FIG. 15 is a cross sectional view of volute housing 32 taken in a direction of water flow (as indicated by arrow 310). Impeller 42 rotates so as to create a centrifugal force of water against an outer periphery 312 of a volute passageway 314 of volute housing 32. As illustrated, drain port 37 includes a leading edge 320 substantially perpendicular to water flow direction 310, a cylindrical outlet 321 and a trailing edge 322 angled with respect to the water flow direction 310. Leading edge 320, in other embodiments, can be tapered with respect to the water flow direction. As illustrated, the angled trailing edge 322 gradually tapers from the outlet 321 of the drain port 37 to the outer periphery 312 of the volute passageway 314. In one embodiment, the angle of the trailing edge 322 with respect to the water flow direction 310 is approximately 15-35°, and in one particular embodiment is 25°. As illustrated in FIGS. 16 and 17, trailing edge 322 includes opposed side edges 324 that taper together along the trailing edge 322. Drain port 37 further includes a tapered top surface 330 that angles inwardly from the outlet 321 so as to define an elongated opening 332 between passageway 314 and the outlet 321. As illustrated, the opening 332 is of a smaller width (as viewed in cross section perpendicular 310) with respect to flow direction 310 than the drain port outlet 321. Due to the configuration of the drain port 37 as illustrated in FIGS. 15-17, an enlarged drain port outlet 321 can be provided while minimizing disruption of water flow within the volute housing 32 along the passageway 314.

Although the present invention has been described with reference to preferred embodiments, workers skilled in the art will recognize that changes can be made in form and detail without departing from the spirit and scope of the present invention.

What is claimed is:

1. A pump assembly, comprising:

a centrifugal pump having an intake, a discharge, a pump chamber, and an impeller disposed within the pump chamber;

a priming system including a passageway fluidly coupled to the pump chamber, two piston assemblies and an air outlet; and a drive assembly including an impeller shaft coupled to the impeller, a drive shaft coupled to the priming system and a clutch assembly coupled to the impeller shaft, the clutch assembly configured to selectively rotationally couple the drive shaft and the impeller shaft, wherein the drive shaft is coaxial with and surrounds the impeller shaft, wherein the two piston assemblies are positioned on opposite sides of the drive shaft and the drive shaft includes an eccentric portion engaging the piston assemblies to provide reciprocating motion of the piston assemblies upon rotation of the drive shaft.

2. The pump assembly of claim 1 wherein each piston assembly includes a piston head movable with respect to a piston cover, each respective piston head being directly connected to the other piston head such that the piston heads move together.

3. The pump assembly of claim 2, further comprising a planetary drive surrounding the eccentric portion and positioned between the two piston assemblies and the eccentric portion.

4. The pump assembly of claim 2, further comprising a block coupled to one of the two piston assemblies and a compression spring positioned between the block and said one piston assembly, the block positioned to contact the eccentric portion of the drive shaft during rotation of the drive shaft.

5. The pump assembly of claim 2 wherein an exit flow path through each piston assembly is on a single side of the respective piston head.

6. The pump assembly of claim 1 wherein the priming system includes a priming valve fluidly coupled to the passageway and a conduit fluidly coupled to the piston assemblies, the priming valve operable between an open configuration, wherein the passageway is fluidly coupled to the conduit, and a closed configuration, wherein the passageway is fluidly isolated from the conduit.

7. The pump assembly of claim 6 and further comprising an auxiliary valve selectively fluidly coupleable to atmosphere and fluidly coupled to the conduit, where in the priming system is operable to remove water from the priming system while the auxiliary valve is fluidly coupled to atmosphere.

8. The pump assembly of claim 1 and further comprising a pressure sensor coupled to the pump, the pressure sensor providing a signal indicative of the pump being primed.

9. The pump assembly of claim 1 and further comprising a first sensor providing a signal indicative of a rotational speed of the drive shaft and a second sensor providing a signal indicative of a rotational speed of the impeller shaft.

10. The pump assembly of claim 9 and further comprising a control system coupled to the first sensor and the second sensor, the control system monitoring relative speeds of the drive shaft and the impeller shaft during priming of the centrifugal pump and configured to disengage the clutch assembly if the drive shaft is rotating at a different speed than the impeller shaft.

11. The pump assembly of claim 1 and further comprising a purge system configured to remove water from the priming system using at least one of a purge valve and compressed air.

12. The pump assembly of claim 1, wherein the centrifugal pump includes a volute housing defining an elongate aperture and a cutwater formed of a replaceable reinforcement element positioned in the aperture.

13. The pump assembly of claim 1, wherein the centrifugal pump includes a volute housing defining a passageway and a drain port, the drain port having a leading edge substantially perpendicular to a direction of water flow in the passageway and a trailing edge tapered at an angle with respect to the direction of water flow.

14. The pump assembly of claim 13, wherein the drain port further includes an outlet and an elongated opening positioned between the passageway and the outlet, wherein the elongate opening has a smaller width than the outlet when viewed in cross section in a direction perpendicular to the water flow.

15. A method of priming a centrifugal pump, comprising:

providing a drive assembly including an impeller shaft, a drive shaft and a clutch assembly, the drive shaft being coaxial with the impeller shaft;

positioning two piston assemblies on opposite sides of the drive shaft, the drive shaft including an eccentric portion engaging the piston assemblies to provide reciprocating motion of the piston assemblies upon rotation of the drive shaft;

rotating the impeller shaft;

engaging the clutch assembly such that the drive shaft rotates with and surrounds the impeller shaft; and operating a primary system coupled with the drive shaft to remove air from the centrifugal pump.

16. The method of claim 15, further comprising:

connecting the two pistons assemblies together with at least one rod such that the two piston assemblies move together as the drive shaft rotates.

17. The method of claim 15, further comprising:

operating a priming valve to fluidly couple a pump chamber of the centrifugal pump with the priming system.

18. The method of claim 15, further comprising:

monitoring relative speed of rotation of the impeller shaft and the drive shaft; and disengaging the clutch assembly based on the monitoring.

19. A pump assembly, comprising:

a centrifugal pump having an intake, a discharge, a pump chamber, a volute housing and an impeller disposed within the pump chamber, the volute housing defining a passageway and a drain port, the drain port further including an outlet and an elongated opening positioned between the passageway and the outlet, wherein the elongated opening has a smaller width than the outlet when viewed in cross section in a direction perpendicular to the water flow;

a priming system including a passageway fluidly coupled to the pump chamber and an air outlet; and a drive assembly including an impeller shaft coupled to the impeller, a drive shaft coupled to the priming system and a clutch assembly coupled to the impeller shaft, the clutch assembly configured to selectively rotationally couple the drive shaft and the impeller shaft.

20. A pump assembly, comprising:

a centrifugal pump having an intake, a discharge, a pump chamber, and an impeller disposed within the pump chamber;

a priming system including a passageway fluidly coupled to the pump chamber, a priming valve fluidly coupled to the passageway and a conduit fluidly coupled with an air outlet, the priming valve operable between an open configuration, wherein the passageway is fluidly coupled to the conduit and a closed configuration, wherein the passageway is fluidly isolated from the conduit;

a drive assembly including an impeller shaft coupled to the impeller, a drive shaft coupled to the priming system and a clutch assembly coupled to the impeller shaft, the clutch assembly configured to selectively rotationally couple the drive shaft and the impeller shaft;

a control system operable to transition the priming valve between the open and closed configurations; and a first sensor providing a signal indicative of a rotational speed of the drive shaft and a second sensor providing a signal indicative of a rotational speed of the impeller shaft, wherein the control system is configured to receive signals from the first sensor and the second sensor and transition the priming valve between the open and closed configurations as a function of the received signals.

* * * * *